US007018322B1

(12) United States Patent
Carter

(10) Patent No.: US 7,018,322 B1
(45) Date of Patent: Mar. 28, 2006

(54) QUARTER-FOLDABLE REBOUNDER WITH IMPROVED FEATURES

(75) Inventor: Albert E. Carter, Provo, UT (US)

(73) Assignee: American Institute of Reboundology, Inc., Springville, UT (US)

( * ) Notice: Subject to any disclaimer, the term of this patent is extended or adjusted under 35 U.S.C. 154(b) by 181 days.

(21) Appl. No.: 10/421,987

(22) Filed: Apr. 23, 2003

(51) Int. Cl.
*A63B 21/00* (2006.01)

(52) U.S. Cl. ..... 482/27; 482/28

(58) Field of Classification Search ..... 482/27–29, 482/130, 142, 904, 66, 71, 51
See application file for complete search history.

(56) References Cited

U.S. PATENT DOCUMENTS

| | | | | |
|---|---|---|---|---|
| 952,871 | A * | 3/1910 | Browder | 182/139 |
| 4,386,772 | A * | 6/1983 | Wu | 482/28 |
| 4,415,151 | A * | 11/1983 | Daniels | 482/28 |
| 5,545,110 | A * | 8/1996 | Hsiang | 482/27 |
| 6,648,799 | B1 * | 11/2003 | Hall | 482/28 |

OTHER PUBLICATIONS

PCT / AU86/00271 IPN 87/06480 Applicant Fuller et al Filing Date Dec. 9, 1986.*
Sheets 1 of 5 to 5 of 5 Entitled "Top Assembly" Dated Dec. 4, 1997 & Nov. 17, 1997.

* cited by examiner

*Primary Examiner*—Jerome W. Donnelly
(74) *Attorney, Agent, or Firm*—John R. Flanagan

(57) ABSTRACT

A quarter-foldable rebounder includes a frame of circular configuration, a circular mat, springs and legs. The frame is formed by four one-piece molded quarter-frame arcuate segments having integral pairs of half-fold and quarter-fold hinges and a rod embedded in each of the quarter-frame segments which anchors outer hooked ends of the mat springs extending into recesses and passages in the quarter-frame segments. The rebounder also includes connectors anchoring inner hooked ends of the mat springs to the outer periphery of the mat. Each of the legs is mounted at one end to one of a pair of spaced wells formed in the underside of the quarter-frame segments for undergoing movement between locked and unlocked and erect and folded positions and is received at the other end in the other of the pair of wells when the leg is at the folded position.

19 Claims, 7 Drawing Sheets

FIG. 1
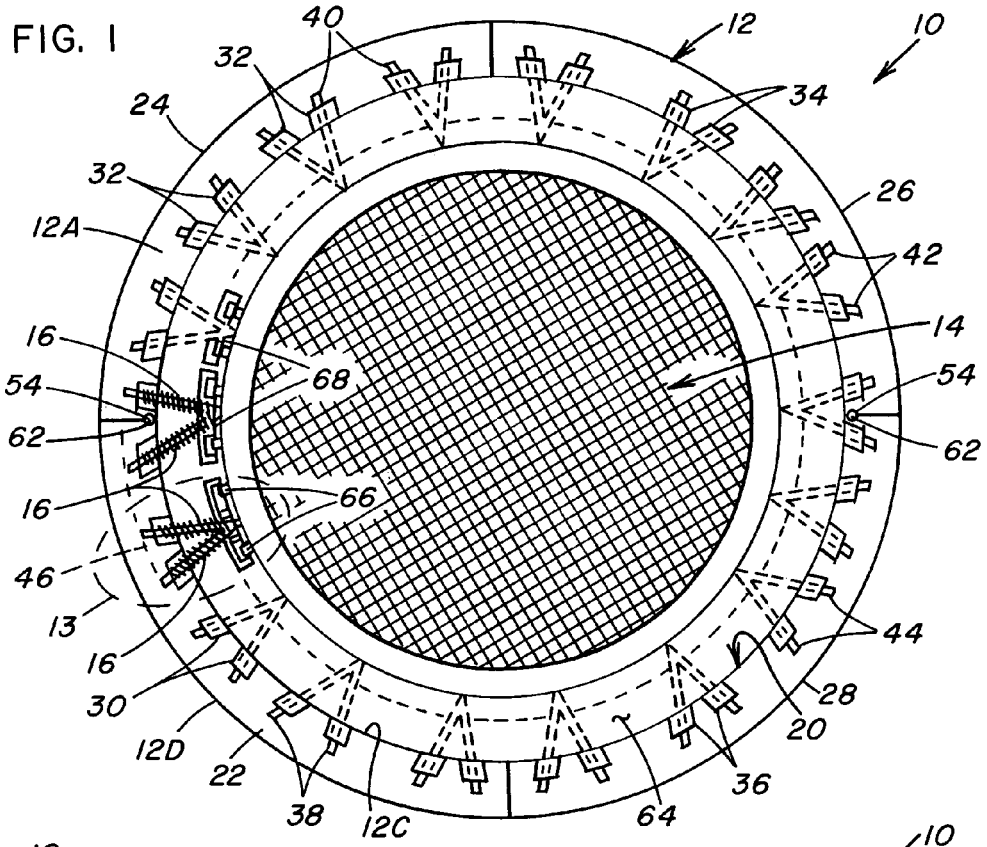
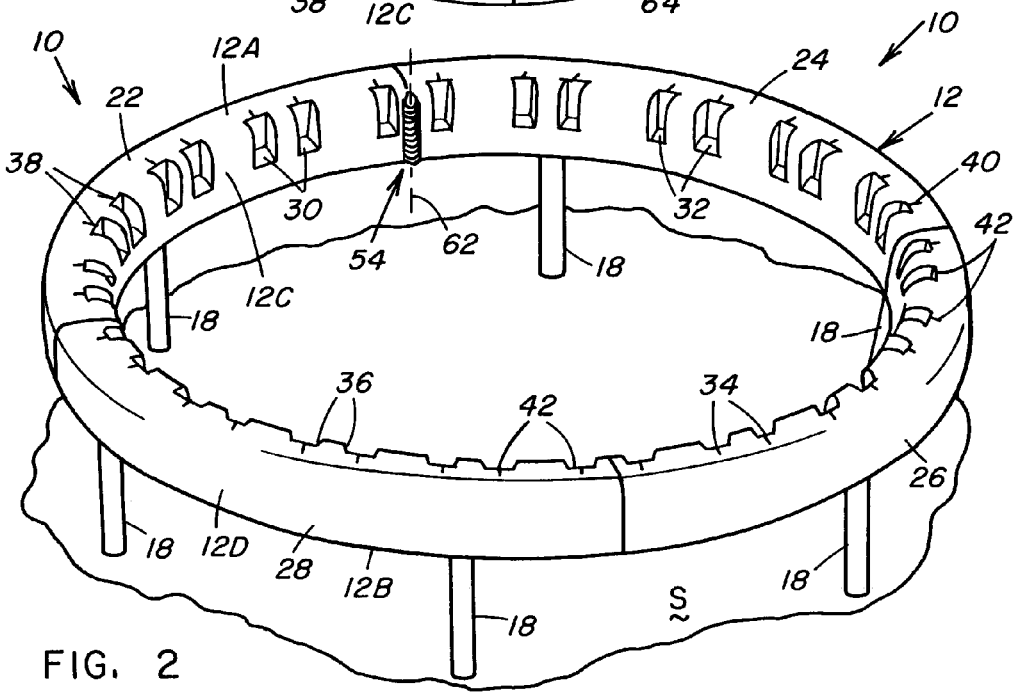
FIG. 2

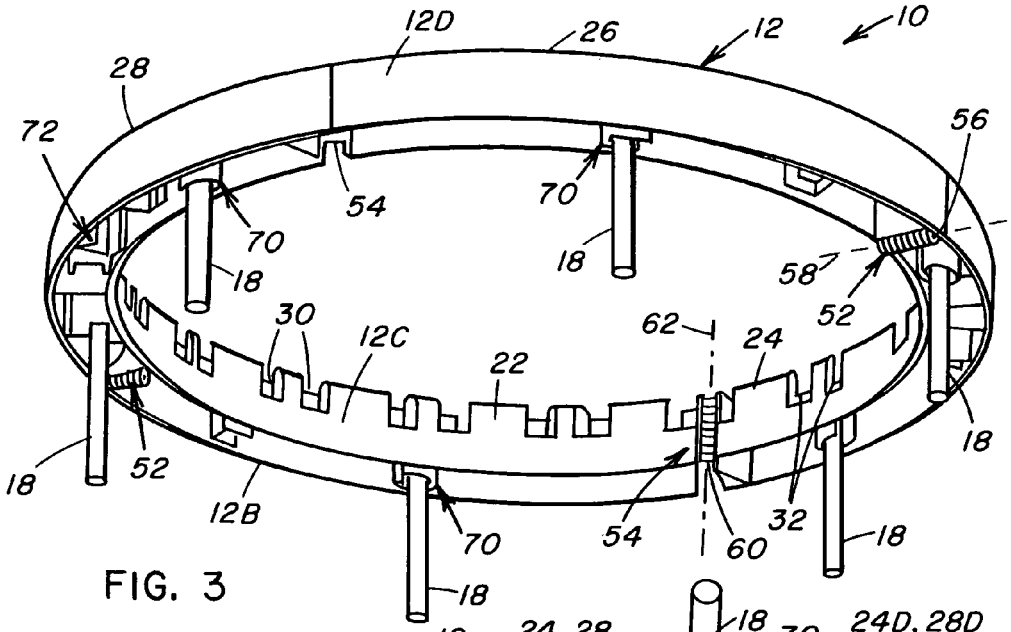
FIG. 3
FIG. 4
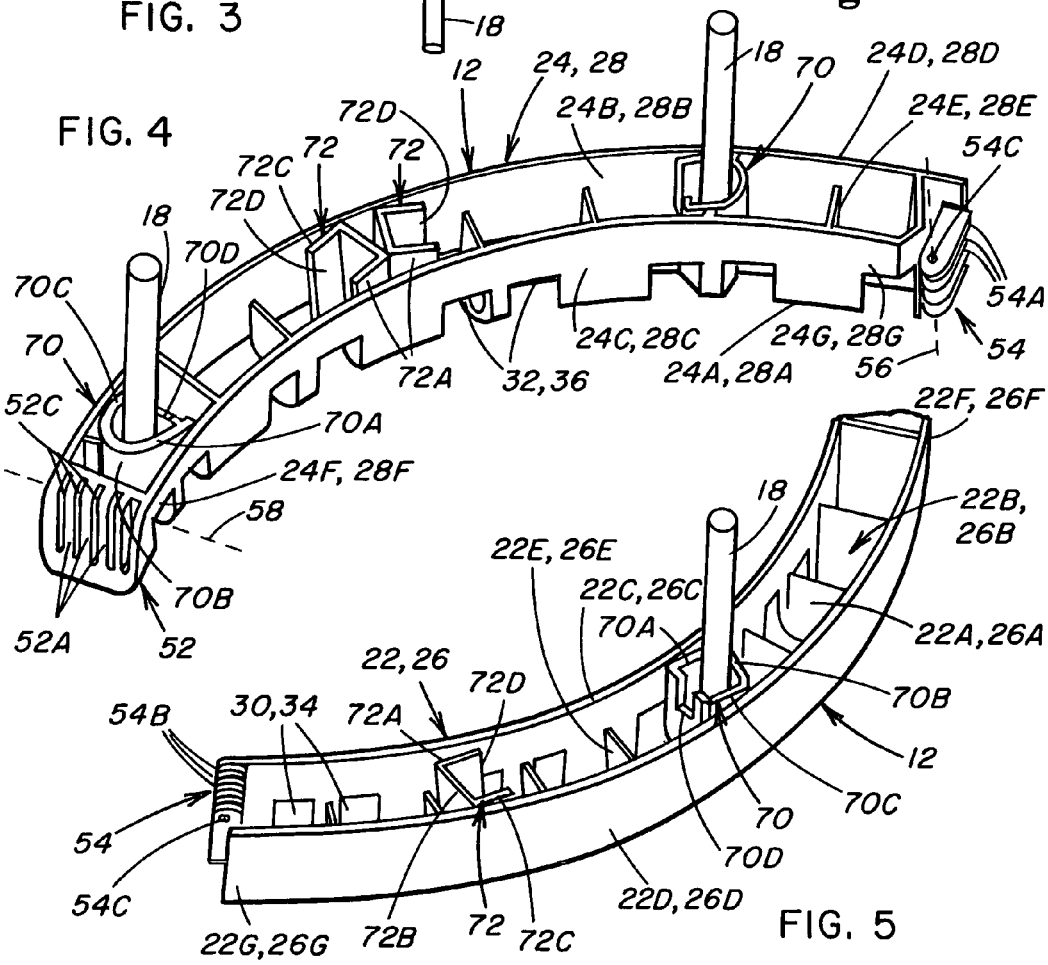
FIG. 5

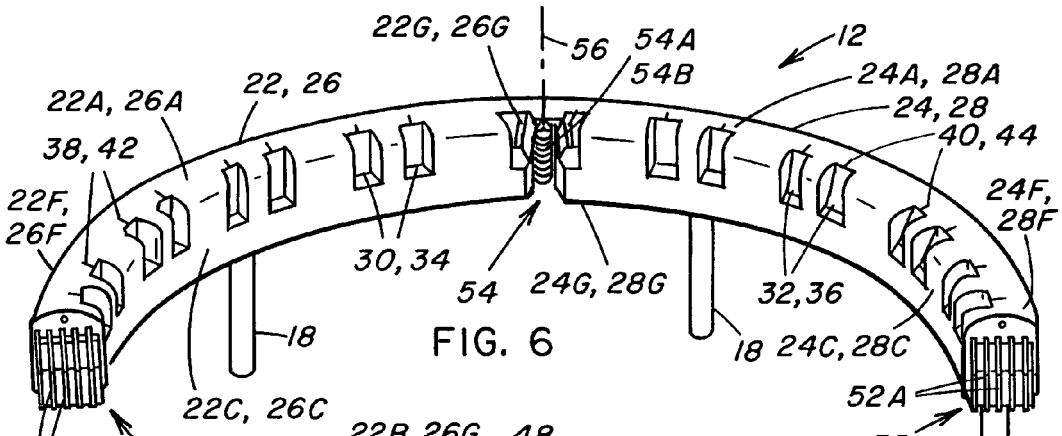
FIG. 6
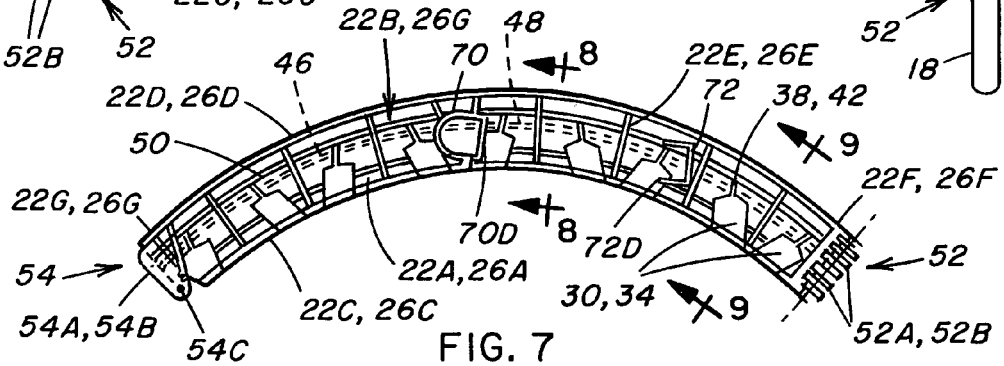
FIG. 7
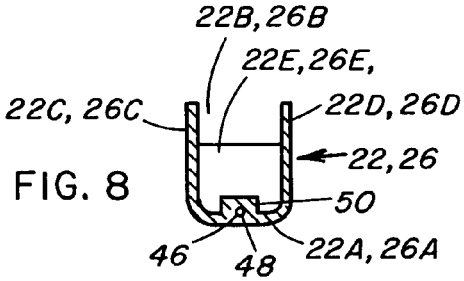
FIG. 8
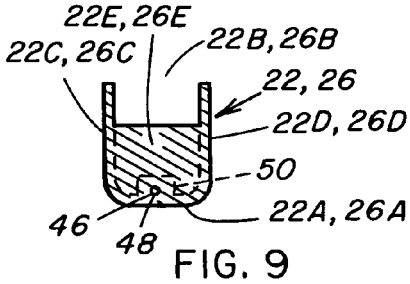
FIG. 9
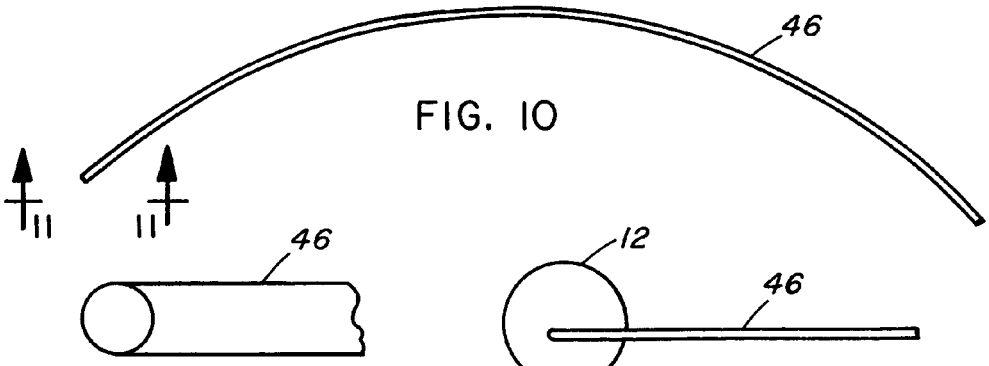
FIG. 10
FIG. 12
FIG. 11

QUARTER-FOLDABLE REBOUNDER WITH IMPROVED FEATURES

BACKGROUND OF THE INVENTION

1. Field of the Invention

The present invention generally relates to the field of exercise equipment and, more particularly, is concerned with a quarter-foldable rebounder with improved features.

2. Description of the Prior Art

Rebound exercise, the bouncing up and down against gravity on a trampoline, is now an accepted form of exercise. It is an alternative to walking, jogging, running, weight lifting and dancing. It is also accepted as an adjunct to any of these and other forms of exercise. Rebounding exercises the entire body at once by combining the forces of acceleration, deceleration and gravity in a vertical mode. There are numerous health benefits to the body to be gained from partaking in rebound exercise. Central among these health benefits are the positive effects of stimulating the lymphatic system of the body and of strengthening the musculoskeletal system without introducing trauma.

Over the past few decades an alternative apparatus to a large bulky trampoline has been developed by the inventor of the subject invention herein. This apparatus is a mini-trampoline, known as a rebounder. The rebounder has received growing acceptance as an affordable device for individuals to use and thus achieve the benefits of rebound exercise. The rebounder is a small device on which a person can exercise in place in the comforts and convenience of one's own house and then which can easily be stored during periods of non-use.

An initial model of the rebounder developed by the subject inventor has a round tubular frame, a small circular mat connected to the frame by a plurality of mat springs and six legs pivotally connected to the frame and when erect supporting the mat parallel to and above the ground. The legs are fitted over studs located equidistant from one another about and pivotally connected to the underside of the frame. Also leg springs are housed inside the legs and connected between the studs and legs so that the legs are biased to unfolded or vertical positions but could be pivotally folded from the vertical positions to horizontal positions in which they would then extend generally parallel to and inside the perimeter of the underside of the frame.

A second model of the rebounder has the frame provided in two parts or halves connected by a pair of hinges each spaced 180 degrees apart so that the two-part frame can be folded in half, or half-folded, and then placed in a carrying case to allow for easier transporting of the rebounder. A third model of the rebounder has the frame provided in four parts or quarters connected by two pairs of hinges each spaced 90 degrees apart from one another so that the four-part frame could be quarter-folded and then placed in an even smaller carrying case. The hinges are pins which fit into ends of the quarter frame parts and are secured thereto by spring bolts. The pins have respective heads at one end which heads when placed side-by-side define complementary halves of a hinge.

The mats and mat springs of all models of the rebounder are interchangeable. The mat is made of permatron or polypropolene with eighteen steel bullhorn-shaped connectors sewed in the peripheral edge of the mat. Each connector is connected to two mat springs. Thirty-six mat springs are provided to extend between and connect to eighteen connectors of the mat and thirty-six clevis pins are inserted into thirty-six holes drilled equidistant from one another and radially through the circular frame.

While these prior art rebounders have proven satisfactory in use for the specific purposes for which they were designed, as with any device from time to time there arises a need to make further improvements of the device.

SUMMARY OF THE INVENTION

The present invention provides a quarter-foldable rebounder designed to satisfy the aforementioned need. The quarter-foldable rebounder of the present invention incorporates improved features which reduce the cost of production and further enhance overall utility and durability of the rebounder. These improved features include four one-piece molded quarter-frame segments with their integral pairs of half-fold and quarter-fold hinges, a rod embedded in an arcuate configuration in each of the quarter-frame segments which anchor outer hooked ends of the mat springs which extend into recesses and passages in the quarter-frame segments, the connectors anchoring the inner hooked ends of the mat springs to the outer periphery of the mat, and the legs which each is mounted at one end to one of a pair of spaced complementary wells formed in the underside of the quarter-frame segments for undergoing movement between locked and unlocked and erected and folded positions and is received at the other end in the other of the pair of wells when the leg is at the folded position.

Accordingly, the present invention is directed to a quarter-foldable rebounder which comprises: (a) a frame of a circular configuration having an upperside and underside spaced apart from one another and inner and outer peripheral sides spaced from one another, the inner peripheral side defining a central opening, the frame including (i) four one-piece molded quarter-frame segments having curved configurations and opposite ends and being successively arranged end-to-end with one another, each of the quarter-frame segments supporting a rod in an arcuate configuration, (ii) a pair of half-fold hinges integrally formed on first ends of the opposite ends of the quarter-frame segments such that the half-fold hinges are spaced apart about one hundred eighty degrees from one another and pivotally interconnect the first ends of the quarter-frame segments such that the quarter-frame segments can be pivoted relative to one another about a pair of half-fold axes defined by the half-fold hinges so as to fold the frame between an unfolded erect condition and a half-folded condition and (iii) a pair of quarter-fold hinges integrally formed on second ends of the opposite ends of the quarter-frame segments such that the quarter-fold hinges are spaced apart about one hundred eighty degrees from one another and located between and spaced apart about ninety degrees from the half-fold hinges and pivotally interconnect the second ends of the quarter-frame segments such that the quarter-frame segments can be pivoted relative to one another about a pair of quarter-fold axes defined by the quarter-fold hinges so as to fold the frame between a half-folded condition and a quarter-folded storage condition; (b) a mat of resilient flexible material disposed in the opening of the frame and having an outer peripheral edge of a circular configuration spaced inwardly from the inner peripheral side of the frame so as to define an annular gap therebetween; (c) a plurality of yieldably resilient elements disposed in the opening of the frame and across the annular gap and spaced apart from one another circumferentially about the outer peripheral edge of the mat and the inner peripheral side of the frame and extending therebetween so as to interconnect the mat to the rods supported by the quarter-frame segments and thereby hold the mat under a preset magnitude of tension; and (d) a plurality of legs each having a pair of opposite ends and being connected to the frame for undergoing movement relative to the underside of the frame between erect positions in which the legs extend transverse to and below the underside of the frame so as to support the frame and mat substantially parallel to and above a support surface when the legs rest on the support surface and folded positions in which the legs extend along the underside of the frame so as to permit the frame to be folded between the unfolded erect condition and the quarter-folded storage condition. Each of the half-fold axes is located adjacent to the underside of the frame. Each of the quarter-fold axes is located adjacent to the inner peripheral side of the frame.

More particularly, each of the quarter-frame segments has a plurality of recesses spaced apart from one another and defined in a corner of the quarter-frame segment formed by the upperside and inner peripheral side thereof and a plurality of passages spaced apart from one another and defined through the upperside thereof and each extending radially from one of the recesses toward but ending short of the outer peripheral side thereof such that the rod supported by each of the quarter-frame segments crosses the passages. Each of the yieldably resilient elements is a coil spring having one end extending into one of the recesses and through one of the passages of the quarter-frame segments and secured to the rod therein.

Furthermore, two of the quarter-frame segments have one pair of complementary wells formed in the underside thereof and two of the quarter-frame segments have two pairs of complementary wells formed in the underside thereof. Each of the legs are pivotally mounted at one end in one of the pair of complementary wells of each pair thereof for undergoing movement between the erect and folded positions and are receivable at the other end within the other of the pair of complementary wells of each pair thereof when the legs is disposed at the folded position. Also, each of the legs at the one end is mounted for undergoing reciprocal and rotatable movement between locked and unlocked positions relative to the one of the pair of complementary wells of each pair thereof while the leg is disposed at the erect position.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a top plan view of a quarter-foldable rebounder incorporating improved features of the present invention.

FIG. 2 is a top perspective view of a round frame and legs of the rebounder in an unfolded erect condition but with a mat and suspension springs of the rebounder omitted.

FIG. 3 is a bottom perspective view of the rebounder of FIG. 2.

FIG. 4 is a bottom perspective view of a first quarter-frame segment of the frame of the rebounder having a pair of legs.

FIG. 5 is a bottom perspective view of a second quarter-frame segment of the frame of the rebounder having a single leg.

FIG. 6 is a top perspective view of a pivotally connected pair of first and second quarter-frame segments of the frame of the rebounder.

FIG. 7 is a bottom plan view of the second quarter-frame segment.

FIG. 8 is an enlarged cross-sectional view of the second quarter-frame segment taken along line 8—8 of FIG. 7.

FIG. 9 is an enlarged cross-sectional view of the second quarter-frame segment taken along line 9—9 of FIG. 7.

FIG. 10 is a plan view of a rod of the rebounder embedded in each of the first and second quarter-frame segments.

FIG. 11 is a fragmentary side elevational view of the rod as seen along line 11—11 of FIG. 10.

FIG. 12 is an enlarged side elevational view of an end portion of the rod enclosed by the circle 12 of FIG. 11.

DETAILED DESCRIPTION OF THE INVENTION

Figure 13:
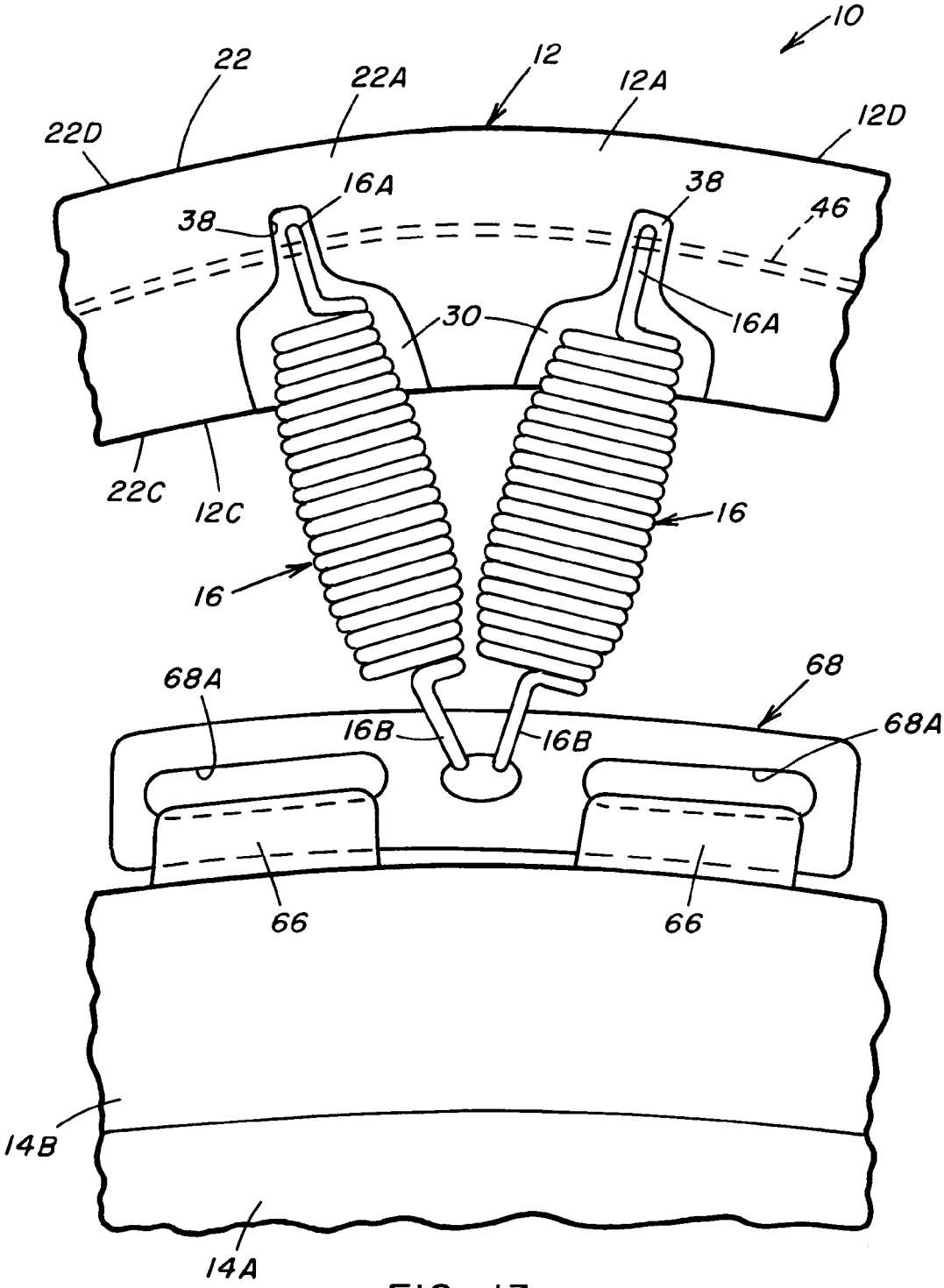
FIG. 13 is an enlarged fragmentary detailed view of the portion of the rebounder enclosed by the circle 13 of FIG. 1 showing one of a plurality of connectors connected to the mat and one pair of the plurality of springs extending between and interconnecting the connector to the rod supported in each of the quarter-frame segments of the frame of the rebounder.
Figure 14:
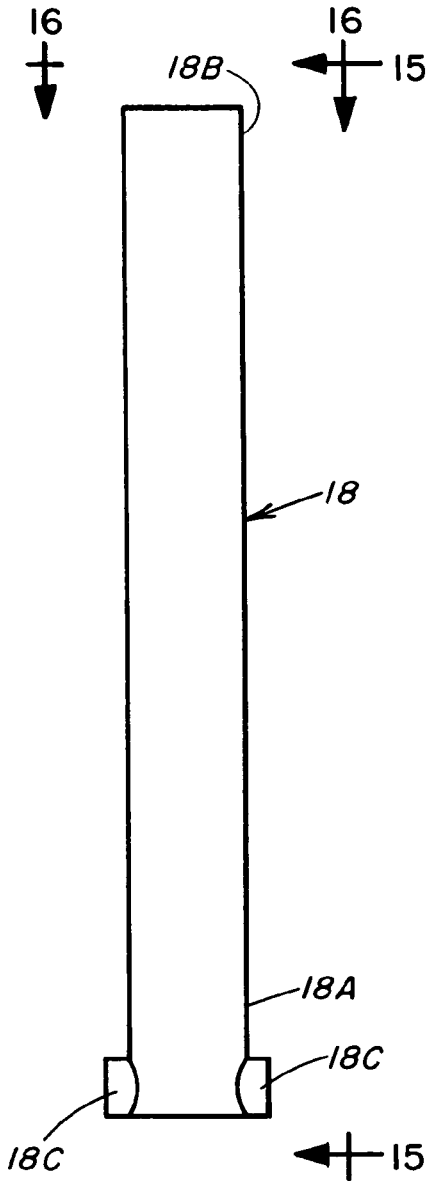
FIG. 14 is an enlarged side elevational view of one of the legs of the rebounder.
Figure 15:
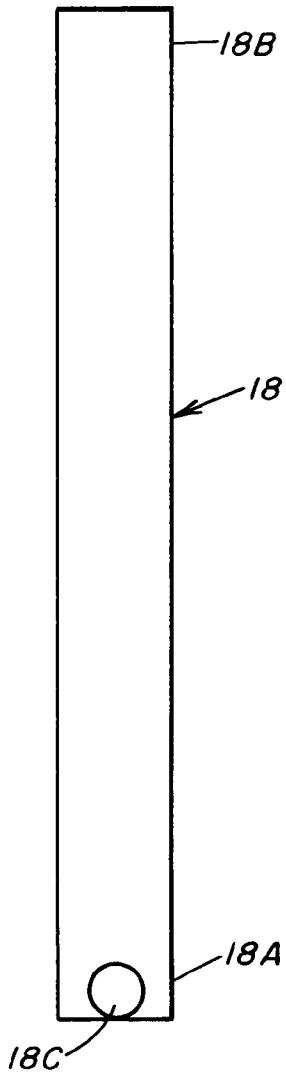
FIG. 15 is another side elevational view of the leg as seen along line 15—15 of FIG. 14.
Figure 16:
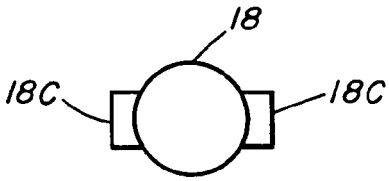
FIG. 16 is an end plan view of the leg as seen along line 16—16 of FIG. 14.

Referring to the drawings and particularly to FIGS. 1 to 3, there is illustrated a quarter-foldable rebounder, generally designated 10, which incorporates improved features of the present invention. The quarter-foldable rebounder 10 basically includes a frame 12, a mat 14, a plurality of yieldably resilient elements in the form of coil springs 16 and a plurality of legs 18.

Referring to FIGS. 1–12, the frame 12 of the rebounder 10 is of circular configuration and has an upperside 12A and underside 12B spaced apart from one another and inner and outer peripheral sides 12C, 12D spaced from one another. The inner peripheral side 12C defines a central opening 20 through the frame 12. The frame 12 includes four one-piece molded quarter-frame segments 22, 24, 26, 28 made of a suitable plastic material and having arcuate, preferably quarter-circular, configurations. The four quarter-frame segments 22–28 when successively arranged and fitted end-to-end with one another form the frame 12. Each of the quarter-frame segments 22–28 has a top wall 22A–28A, open bottom 22B–28B and opposite inner and outer side walls 22C–28C, 22D–28D which are integrally connected together. When the quarter-frame segments 22–28 are fitted together to form the frame 12, the top walls 22A–28A, open bottom 22B–28B, and opposite inner and outer side walls 22C–28C, 22D–28D respectively form the upperside 12A, lowerside 12B and inner and outer peripheral sides 12C, 12D of the frame 12. The top wall 22A–28A and opposite inner and outer side walls 22C–28C, 22D–28D of each quarter-frame segment 22–28 are rigidly and integrally connected together so as to provide the quarter-frame segment 22–28 and thereby the frame 12 with a U-shaped cross-sectional configuration. A plurality of cross walls 22E–28E are provided in spaced apart relationship from one another circumferentially about the frame 12. The cross walls 22E–28E extend between and rigidly and integrally connect with the top walls 22A–28A and opposite inner and outer side walls 22C–28C, 22D–28D.

The quarter-frame segments 22–28 also include a plurality of pairs of wells or recesses 30, 32, 34, 36 defined in an inner and upper corner of the quarter-frame segments 22–28 formed by the top walls 22A–28A and inner side walls 22C–28C thereof and thereby in the upperside 12A and inner peripheral side 12C of the frame 12. Also, the quarter-frame segments 22–28 further include a plurality of passages 38, 40, 42, 44 defined in the top walls 22A–28A and thereby in the upperside 12A of the frame 12. The passages 38–44 extend in the top walls 22A–28A radially from the pairs of recesses 30–36 toward but ending short of the outer side walls 22D–28D of the quarter-frame segments 22–28 and thereby in the upperside 12A of the frame 12. A plurality of rods 46 of circular cross-sectional configuration and made of any suitable material, such as round steel bar, are received and held in arcuate configurations through respective passageways 48 defined longitudinally through ribs 50 integrally and fixedly attached and running on the bottom of the top walls 22A–28A of the quarter-frame segments 22–28 such that each of the rods 46 crosses the passages 38–44 in each of the quarter-frame segments 22–28. In such manner, one rod 44 is supported by each of the quarter-frame segments 22–28.

Figure 20:
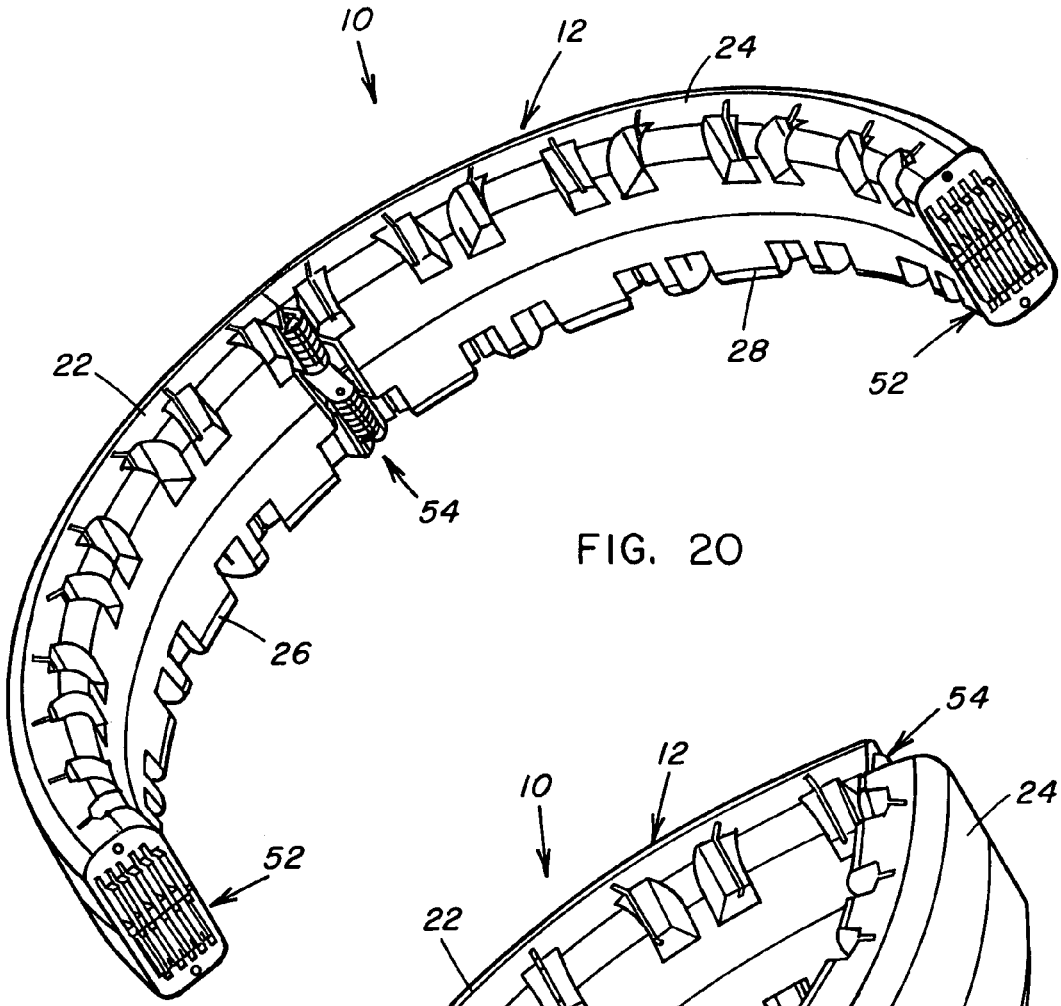
FIG. 20 is a perspective view of the rebounder frame shown in a half-folded condition.
Figure 21:
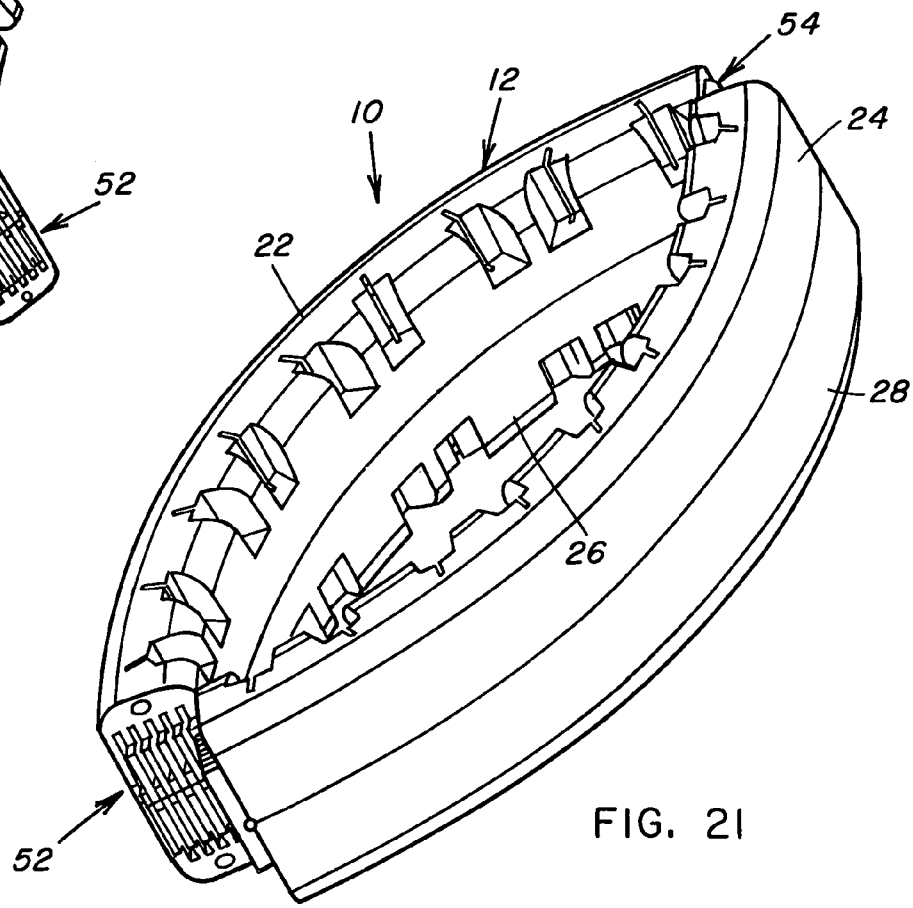
FIG. 21 is a perspective view of the rebounder frame shown in a quarter-folded storage condition.

The frame 12 of the rebounder 10 also includes a pair of half-fold hinges 52 and a pair of quarter-fold hinges 54. Each of the half-fold hinges 52 are formed by slidably interfitting pairs of spaced apart side-by-side tabs 52A, 52B with aligned apertures 52C receiving a pin 56 therethrough. The tabs 52A, 52B of the half-fold hinges 52 are integrally formed on first ends 22F–28F of opposite ends 22F–28F, 22G–28G of the quarter-frame segments 22–28 such that the half-fold hinges 52 are spaced apart about one hundred eighty degrees from one another. The half-fold hinges 52 pivotally interconnect the first ends 22F–28F of the quarter-frame segments 22–28 so that the quarter-frame segments 22–28 can be pivoted relative to one another about a pair of half-fold axes 58 defined by the pins 56 of the half-fold hinges 52 adjacent to the underside 12B of the frame 12 so that the frame 12 can be folded between an unfolded erect condition, as seen in FIGS. 2 and 3, and a half-folded condition, as seen in FIG. 20. Similarly, the quarter-fold hinges 54 are formed by slidably interfitting spaced apart side-by-side tabs 54A, 54B with aligned apertures 54C receiving a pin 60 therethrough. The tabs 54A, 54B on second ends 22G–28G of the opposite ends of the quarter-frame segments 22–28 such that the quarter-fold hinges 54 are spaced apart about one hundred eighty degrees from one another and located between and spaced apart about ninety degrees from the half-fold hinges 52. The quarter-fold hinges 54 pivotally interconnect the second ends 22G–28G of the quarter-frame segments 22–28 such that the quarter-frame segments 22–28 can be pivoted relative to one another about a pair of quarter-fold axes 62 defined by the pins 60 of the quarter-fold hinges 54 adjacent to the inner peripheral side 12C of the frame 12 so that the frame 12 can be folded between the half-folded condition, as seen in FIG. 10, and a quarter-folded storage condition, as seen in FIG. 21.

Referring to FIGS. 1 and 13, the mat 14 of the rebounder 10, made of a suitable resilient flexible material, such as permatron or polyprolene, is disposed in the opening 20 of the frame 12. The mat 14 has a main or central portion 14A with an outer peripheral edge 14B thereon of an annular configuration spaced inwardly from the inner peripheral side 12C of the frame 12 so as to define an annular gap 64 therebetween. The mat 14 also has a plurality of strap loops 66 of suitable material, such as seatbelt strap material, attached to the main or central portion 14A, such as by being stitched thereto, which strap loops 66 extend outwardly from therefrom. The mat 14 further has a plurality of connectors 68 each having a pair of eyelets 68A which receive two of the strap loops 66 such that the strap loops 66 secure the connectors 68 to the outer peripheral edge 14B of the mat 14 at locations circumferentially spaced apart from one another about the outer peripheral edge 14B of the mat 14.

Referring still to FIGS. 1 and 13, the coil springs 16 of the rebounder 10 are provided in pairs thereof disposed in the opening 20 of the frame 12 and across the annular gap 64. The pairs of springs 16 are spaced apart from one another circumferentially about the outer peripheral edge 14B of the mat 14 and the inner peripheral side 12C of the frame 12 and extend therebetween so as to interconnect the frame 12 and the connectors 68 secured to the mat 14 and thereby hold the mat 14 under a preset magnitude of tension. More particularly, each of the coil springs 16 has outer and inner hooks 16A, 16B formed at its opposite ends. The outer ends of the coil springs 16 extend into the recesses 30–36 of the quarter-frame segments 22–28. The rods 46 supported in the passageways 48 through the ribs 50 on the quarter-frame segments 22–28 receive thereover and anchor the outer hooks 16A of the springs 16 which extend through the passages 38–44 of the quarter-frame segments. The connectors 68 on the mat 14 receive through their eyelets 68A and thereby anchor the inner hooks 16B of the springs to the outer peripheral edge 14B of the mat 14.

Figures 17, 18, 19:
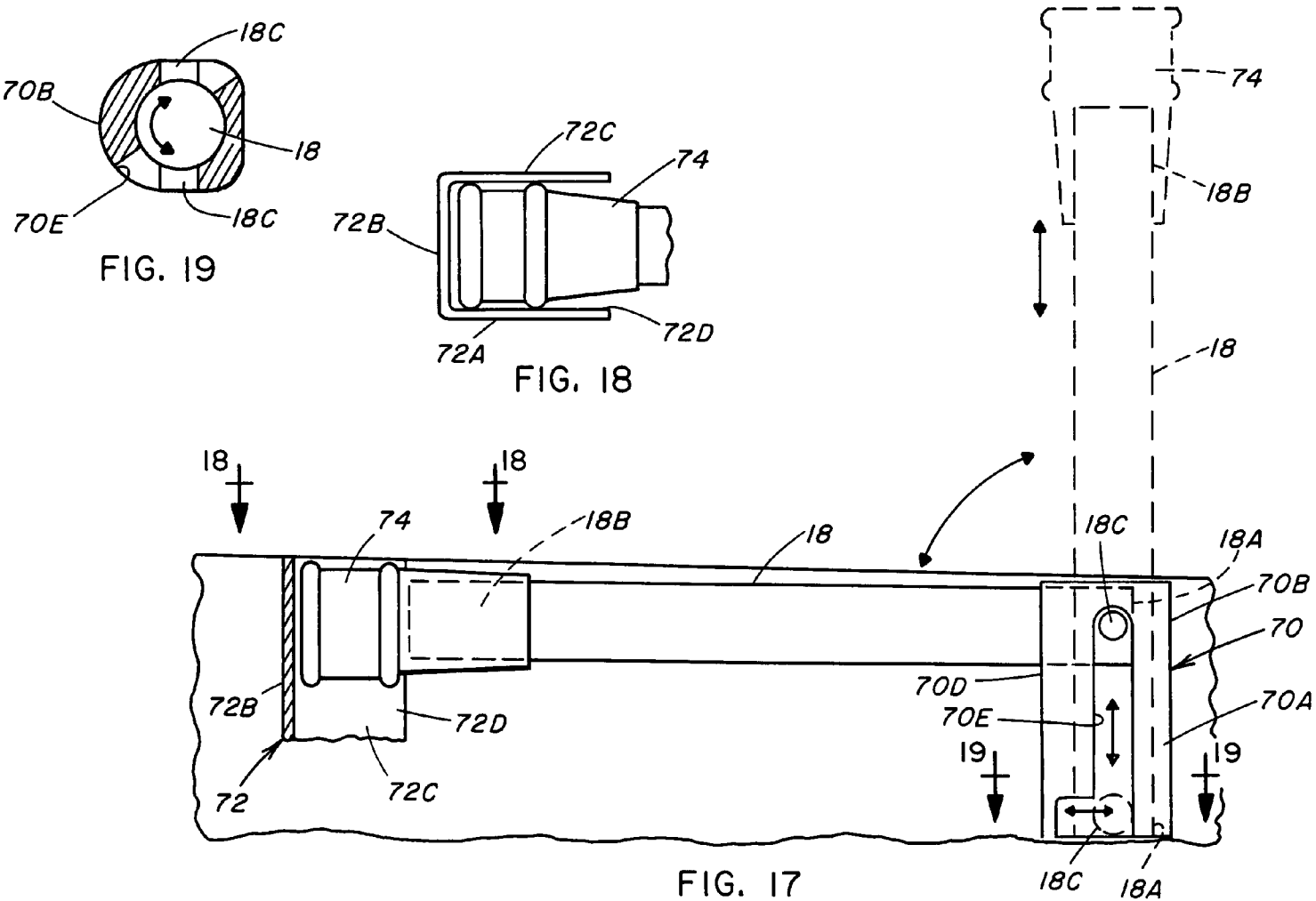
FIG. 17 is an enlarged side elevational view with portions sectioned showing a leg in dashed line form in an erect position and in solid line form in a stored position.
FIG. 18 is a fragmentary bottom view of the outer end of the leg as seen along line 18—18 of FIG. 17.
FIG. 19 is a cross-sectional view of the inner end of the leg taken along line 19—19 of FIG. 17.

Referring to FIGS. 2–7 and 14–19, the plurality of legs 18 of the rebounder 10 are spaced apart about and pivotally connected to the underside 12B of the frame 12 for undergoing movement between erect and folded positions, as respectively seen in dashed line and solid line forms in FIG. 17, relative to a support surface S. In the erect positions, the legs 18 extend generally transverse to and outwardly from the underside 12B of the frame 12 so as to support the frame 12 and mat 14 substantially parallel to and above a support surface S with the legs 18 resting on the support surface S. In the folded positions, the legs 18 extend generally parallel to and along the underside 12B of the frame 12 so as to permit the frame 12 to be folded between the unfolded erect condition and quarter-folded storage condition. Two of the quarter-frame segments 22, 26 have one pair of wells 70, 72 formed on the bottom of the top wall 22A, 26A of the quarter-frame segments 22, 26 and extending to the underside 12B of the frame 12 whereas the other two of the quarter-frame segments 24, 28 have two pairs of the wells 70, 72 formed on the bottom of the top wall 24A, 28A of the quarter-frame segments 24, 28 and extending to the underside 12B of the frame 12. Each of the wells 70, 72 has three sides 70A–70C, 72A–72C which form an opening 70D, 72D facing toward one another. Each of legs 18 has a pair of opposite ends 18A, 18B and are pivotally mounted to elongated enclosed L-shaped slots 70E formed in opposing sides 70A, 70C of the wells 70 by stub shafts 18C integrally formed at one of the ends 18A so as to protrude outwardly therefrom in opposite directions and in a transverse relationship to the length of the leg 18. The stub shafts 18C fit into the L-shaped slots 70E so as to slidably and pivotally mount each of the legs 18 to the one of the wells 70 for undergoing movement between the erect and folded positions and also for undergoing reciprocal and rotatable movement between locked and unlocked positions relative to the one of the wells 70 while the leg 18 is disposed at the erect position, as seen in dashed line form in FIG. 17. When the legs 18 are pivoted to their folded positions as seen in solid line form in FIG. 17, their other ends 18B, which may each have a cylindrical rubber foot 74 fitted thereover, may tightly fit within the other wells 72 so as to frictionally, but removably, retain the legs 18 at the folded storage positions until removed by the user.

In one exemplary embodiment of the rebounder 10, the frame 12 has a diameter of forty inches, the legs 18 are six in number, nine inches in length and one inch in diameter. There are thirty-six coil springs 16 and eighteen plastic connectors 68. The mat 14 is twenty-eight inches in diameter. It will be readily understood at these parts of the rebounder 10 can be of other sizes and numbers.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A quarter-foldable rebounder, comprising:

(a) a frame of circular configuration having an upperside and underside spaced apart from one another and inner and outer peripheral sides spaced from one another, said inner peripheral side defining a central opening, said frame including (i) four one-piece molded quarter-frame segments having curved configurations and opposite ends and being successively arranged end-to-end with one another, each of said quarter-frame segments supporting a rod in an arcuate configuration within the interior of said quarter-frame segments, each of said quarter-frame segments further having a plurality of recesses spaced apart from one another and defined in a corner of said quarter-frame segment formed by said upperside and inner peripheral side thereof and a plurality of passages spaced apart from one another and defined through said upperside thereof and each extending radially from one of said recesses toward but ending short of said outer peripheral side thereof such that said rod supported by each of said quarter-frame segments crosses said passages, (ii) a pair of half-fold hinges integrally formed on first ends of said opposite ends of said quarter-frame segments such that said half-fold hinges are spaced apart about one hundred eighty degrees from one another and pivotally interconnect said first ends of said quarter-frame segments such that said quarter-frame segments can be pivoted relative to one another about a pair of half-fold axes defined by said half-fold hinges so that said frame can be folded between an unfolded erect condition and a half-folded condition, and (iii) a pair of quarter-fold hinges integrally formed on second ends of said opposite ends of said quarter-frame segments such that said quarter-fold hinges are spaced apart about one hundred eighty degrees from one another and located between and spaced apart about ninety degrees from said half-fold hinges and pivotally interconnect said second ends of said quarter-frame segments such that said quarter-frame segments can be pivoted relative to one another about a pair of quarter-fold axes defined by said quarter-fold hinges so that said frame can be folded between said half-folded condition and a quarter-folded storage condition;

(b) a mat of resilient flexible material disposed in said opening of said frame and having an outer peripheral edge of a circular configuration spaced inwardly from said inner peripheral side of said frame so as to define an annular gap therebetween;

(c) a plurality of pairs of yieldably resilient elements disposed in said opening of said frame and across said annular gap and spaced apart from one another circumferentially about said outer peripheral edge of said mat and said inner peripheral side of said frame and extending therebetween so as to interconnect said mat to said rods supported by said quarter-frame segments and thereby hold said mat under a preset magnitude of tension; and (d) a plurality of legs each having a pair of opposite ends and being connected to said frame for undergoing movement relative to said underside of said frame between erected positions in which said legs extend transverse to and below said underside of said frame so as to support said frame and mat substantially parallel to and above a support surface when said legs rest on the support surface and folded positions in which said legs extend along said underside of said frame so as to permit said frame to be folded between said unfolded erect condition and said quarter-folded storage condition.

2. The rebounder of claim 1 wherein each of said half-fold axes is located adjacent to said underside of said frame.

3. The rebounder of claim 1 wherein each of said quarter-fold axes is located adjacent to said inner peripheral side of said frame.

4. The rebounder of claim 1 wherein each of said yieldably resilient elements is a coil spring having one end extending into one of said recesses and through one of said passages of said quarter-frame segments and secured to said rod crossing said passage.

5. The rebounder of claim 4 wherein said mat includes a central portion and a plurality of strap loops spaced apart from one another and attached to said central portion of said mat about said outer peripheral edge of said mat so as to extend outwardly therefrom.

6. The rebounder of claim 5 wherein said mat also includes a plurality of connectors each secured to said central portion of said mat by at least one of said strap loops.

7. The rebounder of claim 6 wherein each of said coil springs has another end opposite said one end, said another end being secured to one of said connectors.

8. A quarter-foldable rebounder, comprising:

(a) a frame of circular configuration having an upperside and underside spaced apart from one another and inner and outer peripheral sides spaced from one another, said inner peripheral side defining a central opening, said frame including (i) four one-piece molded quarter-frame segments having curved configurations and opposite ends and being successively arranged end-to-end with one another, each of said quarter-frame segments supporting a rod in an arcuate configuration, (ii) a pair of half-fold hinges integrally formed on first ends of said opposite ends of said quarter-frame segments such that said half-fold hinges are spaced apart about one hundred eighty degrees from one another and pivotally interconnect said first ends of said quarter-frame segments such that said quarter-frame segments can be pivoted relative to one another about a pair of half-fold axes defined by said half-fold hinges so that said frame can be folded between an unfolded erect condition and a half-folded condition, and (iii) a pair of quarter-fold hinges integrally formed on second ends of said opposite ends of said quarter-frame segments such that said quarter-fold hinges are spaced apart about one hundred eighty decrees from one another and located between and spaced apart about ninety decrees from said half-fold hinges and pivotally interconnect said second ends of said quarter-frame segments such that said quarter-frame segments can be pivoted relative to one another about a pair of quarter-fold axes defined by said quarter-fold hinges so that said frame can be folded between said half-folded condition and a quarter-folded storage condition;

(b) a mat of resilient flexible material disposed in said opening of said frame and having an outer peripheral edge of a circular configuration spaced inwardly from said inner peripheral side of said frame so as to define an annular gap therebetween;

(c) a plurality of pairs of yieldably resilient elements disposed in said opening of said frame and across said annular gap and spaced apart from one another circumferentially about said outer peripheral edge of said mat and said inner peripheral side of said frame and extending therebetween so as to interconnect said mat to said rods supported by said quarter-frame segments and thereby hold said mat under a preset magnitude of tension; and (d) a plurality of legs each having a pair of opposite ends and being connected to said frame for undergoing movement relative to said underside of said frame between erected positions in which said legs extend transverse to and below said underside of said frame so as to support said frame and mat substantially parallel to and above a support surface when said legs rest on the support surface and folded positions in which said legs extend along said underside of said frame so as to permit said frame to be folded between said unfolded erect condition and said quarter-folded storage condition, wherein two of said quarter-frame segments has one pair of wells formed in said underside thereof and two of said quarter-frame segments having two pairs of wells formed in said underside thereof, each of said legs being pivotally mounted at one end in one of said pair of wells of each pair thereof for undergoing movement between said erected and folded positions and being receivable at the other end within the other of said pair of wells of each pair thereof when said legs is disposed at said folded position.

9. The rebounder of claim 8 wherein each of said legs at said one end also being mounted for undergoing reciprocal and rotatable movement between locked and unlocked positions relative to said one of said pair of wells of each pair thereof while said leg is disposed at said erect position.

10. The rebounder of claim 1 wherein each of two of said quarter-frame segments is supported by one of said legs.

11. The rebounder of claim 1 wherein each of two of said quarter-frame segments is supported by two of said legs.

12. A quarter-foldable rebounder, comprising:

(a) a frame of a circular configuration having an upperside and underside spaced apart from one another and inner and outer peripheral sides spaced from one another, said inner peripheral side defining a central opening, said frame including (i) four one-piece molded quarter-frame segments having curved configurations and opposite ends and being successively arranged end-to-end with one another, (ii) a pair of half-fold hinges integrally formed on first ends of said opposite ends of said quarter-frame segments such that said half-fold hinges are spaced apart about one hundred eighty degrees from one another and pivotally interconnect said first ends of said quarter-frame segments such that said quarter-frame segments can be pivoted relative to one another about a pair of half-fold axes defined by said half-fold hinges so that said frame can be folded between an unfolded erect condition and a half-folded condition, (iii) a pair of quarter-fold hinges integrally formed on second ends of said opposite ends of said quarter-frame segments such that said quarter-fold hinges are spaced apart about one hundred eighty degrees from one another and located between and spaced apart about ninety degrees from said half-fold hinges and pivotally interconnect said second ends of said quarter-frame segments such that said quarter-frame segments can be pivoted relative to one another about a pair of quarter-fold axes defined by said quarter-fold hinges so that said frame can be folded between said half-folded condition and a quarter-folded storage condition;

(b) a mat of resilient flexible material disposed in said opening of said frame and having an outer peripheral edge of a circular configuration spaced inwardly from said inner peripheral side of said frame so as to define an annular gap therebetween;

(c) a plurality of pairs of yieldably resilient elements disposed in said opening of said frame and across said annular gap and spaced apart from one another circumferentially about said outer peripheral edge of said mat and said inner peripheral side of said frame and extending therebetween so as to interconnect said mat and said quarter-frame segments and thereby hold said mat under a preset magnitude of tension; and (d) a plurality of legs each having a pair of opposite ends and being connected to said frame for undergoing movement relative to said underside of said frame between erect positions in which said legs extend transverse to and below said underside of said frame so as to support said frame and mat substantially parallel to and above a support surface when said legs rest on the support surface and folded positions in which said legs extend along said underside of said frame so as to permit said frame to be folded between said unfolded erect condition and said quarter-folded storage condition, two of said quarter-frame segments having one pair of wells formed in said underside thereof and two of said quarter-frame segments having two pairs of wells formed in said underside thereof, each of said legs being pivotally mounted at one end in one of said pair of wells of each pair thereof for undergoing movement between said erect and folded positions and being receivable at the other end within the other of said pair of wells of each pair thereof when said legs is disposed at said folded position.

13. The rebounder of claim 12 wherein each of said legs at said one end also being mounted for undergoing reciprocal and rotatable movement between locked and unlocked positions relative to said one of said pair of wells of each pair thereof while said leg is disposed at said erect position.

14. The rebounder of claim 12 wherein each of said half-fold axes is located adjacent to said underside of said frame.

15. The rebounder of claim 12 wherein each of said quarter-fold axes is located adjacent to said inner peripheral side of said frame.

16. The rebounder of claim 12 wherein each of said quarter-frame segments has a plurality of recesses spaced apart from one another and defined in a corner of said quarter-frame segment formed by said upperside and inner peripheral side thereof.

17. The rebounder of claim 15 wherein each of said yieldably resilient elements is a coil spring having one end extending into one of said recesses and secured to one of said quarter-frame segments.

18. The rebounder of claim 17 wherein said mat includes a central portion and a plurality of strap loops spaced apart from one another and attached to said central portion of said mat about said outer peripheral edge of said mat so as to extend outwardly therefrom.

19. The rebounder of claim 18 wherein said mat also includes a plurality of connectors each secured to said central portion of said mat by at least one of said strap loops, each of said coil springs also having another end opposite said one end, said another end being secured to one of said connectors.

* * * * *